US007578747B2

(12) United States Patent
Reilly

(10) Patent No.: US 7,578,747 B2
(45) Date of Patent: Aug. 25, 2009

(54) EXERCISE AND STRETCHING POLE WITH FLEXIBLE HANDLE

(76) Inventor: Hugh A. Reilly, 2435 Oaks Cir., Huntingdon Valley, PA (US) 19006

( * ) Notice: Subject to any disclaimer, the term of this patent is extended or adjusted under 35 U.S.C. 154(b) by 0 days.

(21) Appl. No.: 11/627,927

(22) Filed: Jan. 26, 2007

(65) Prior Publication Data

US 2007/0275834 A1 Nov. 29, 2007

Related U.S. Application Data

(63) Continuation-in-part of application No. 09/968,423, filed on Oct. 1, 2001, now abandoned.

(60) Provisional application No. 60/236,658, filed on Sep. 29, 2000, provisional application No. 60/271,522, filed on Feb. 26, 2001, provisional application No. 60/762,555, filed on Jan. 26, 2006.

(51) Int. Cl.
*A63B 69/36* (2006.01)

(52) U.S. Cl. ..... 473/219; 473/266; 473/409

(58) Field of Classification Search ..... 473/219, 473/266, 274–276, 449, 458, 464, 409; 482/14, 482/15, 18, 23, 25, 33, 38, 148, 92, 93
See application file for complete search history.

(56) References Cited

U.S. PATENT DOCUMENTS

| | | | | |
|---|---|---|---|---|
| 2,714,008 | A * | 7/1955 | Urban | 482/126 |
| 3,109,244 | A * | 11/1963 | Trifaro et al. | 434/252 |
| 3,451,675 | A * | 6/1969 | Burzenski | 482/126 |
| 4,249,729 | A * | 2/1981 | Gabrielidis | 473/464 |
| 4,402,506 | A * | 9/1983 | Jones | 482/70 |
| 4,555,111 | A * | 11/1985 | Alvarez | 473/457 |
| 5,029,860 | A * | 7/1991 | Ehrich | 473/296 |
| 5,282,619 | A * | 2/1994 | Napolitano et al. | 473/239 |
| 5,368,533 | A * | 11/1994 | Feuer et al. | 482/70 |
| 5,403,256 | A * | 4/1995 | Squires | 482/91 |
| 5,582,407 | A * | 12/1996 | Sorenson | 473/256 |
| 5,599,021 | A * | 2/1997 | Lary et al. | 473/219 |
| 6,213,891 | B1 * | 4/2001 | Moore | 473/300 |

* cited by examiner

*Primary Examiner*—Nini Legesse
(74) *Attorney, Agent, or Firm*—Fox Rothschild LLP

(57) ABSTRACT

A device and method for stretching muscles and increasing flexibility. A rod like device is used with various exercises and body motions to stretch and increase flexibility. The rod has a handle of which at least a portion is flexible so as to be capable of being bent relative to the remainder of the device during use. This flexibility in the handle helps to relieve the stress on the hands and wrists of the user.

11 Claims, 7 Drawing Sheets

FIG.1
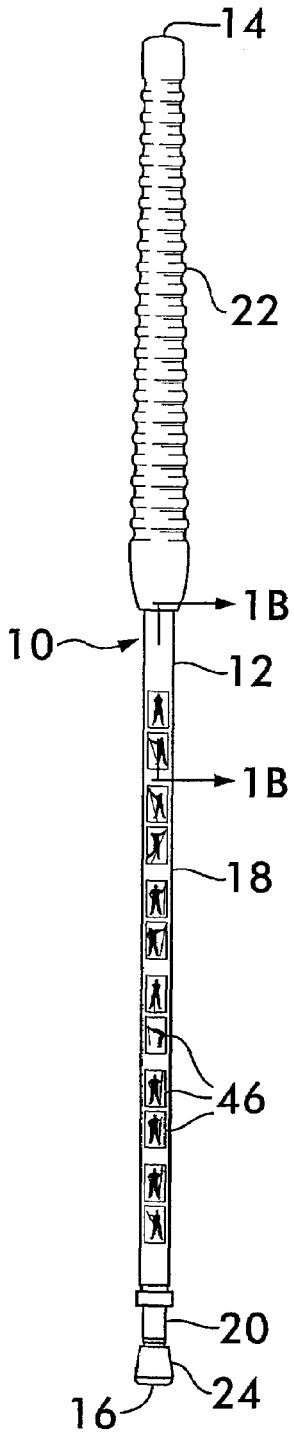
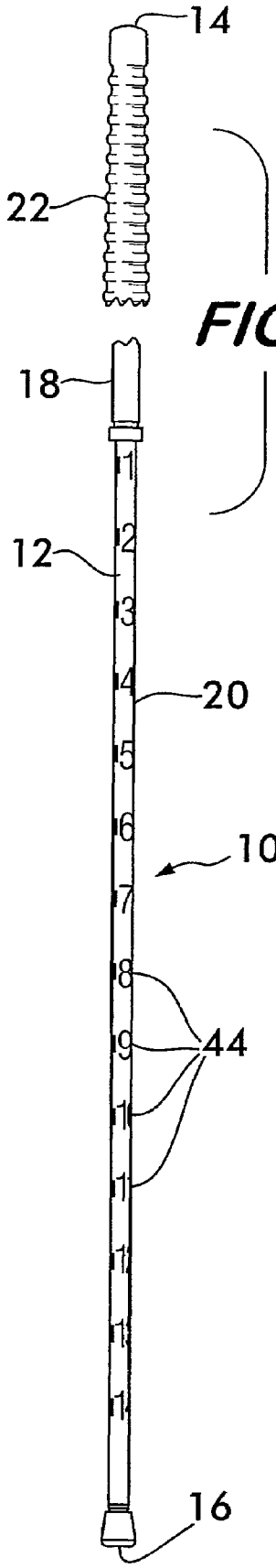
FIG.1A

FIG.2
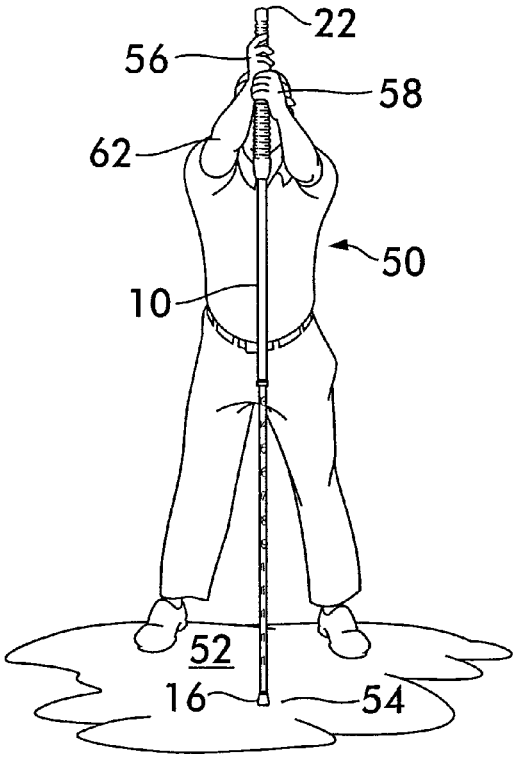
FIG.2A
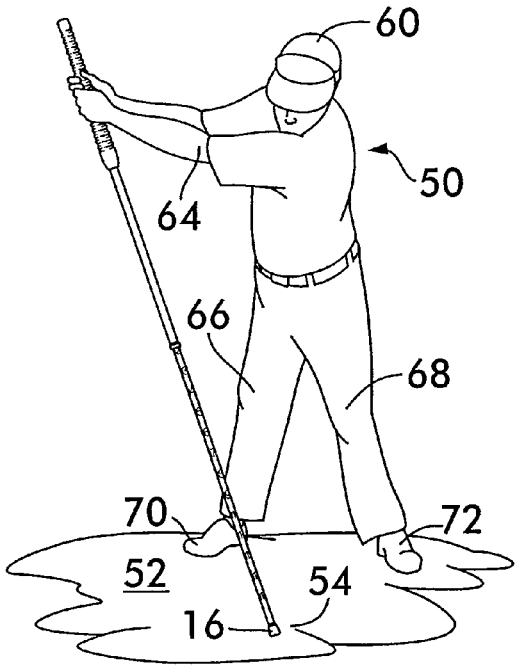
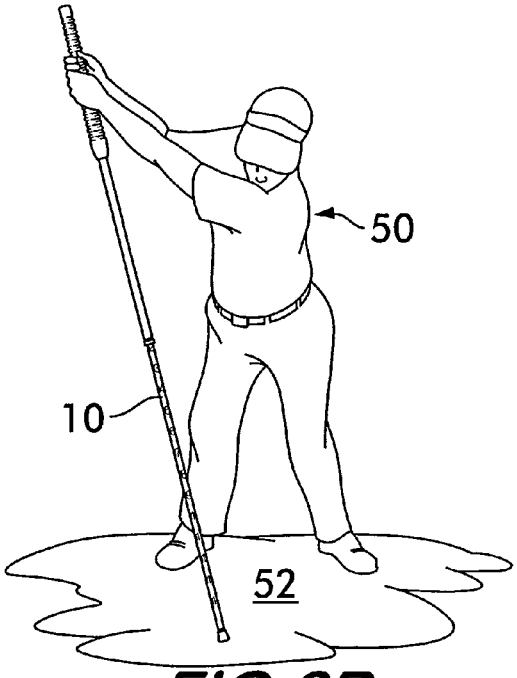
FIG.2B
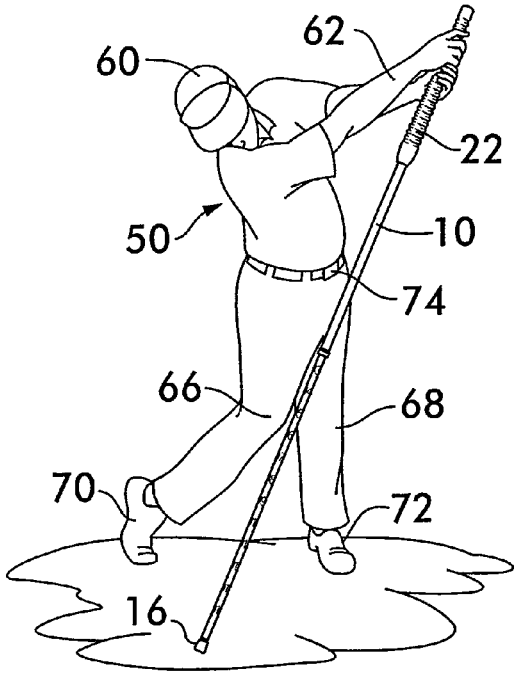
FIG.2C

FIG.8
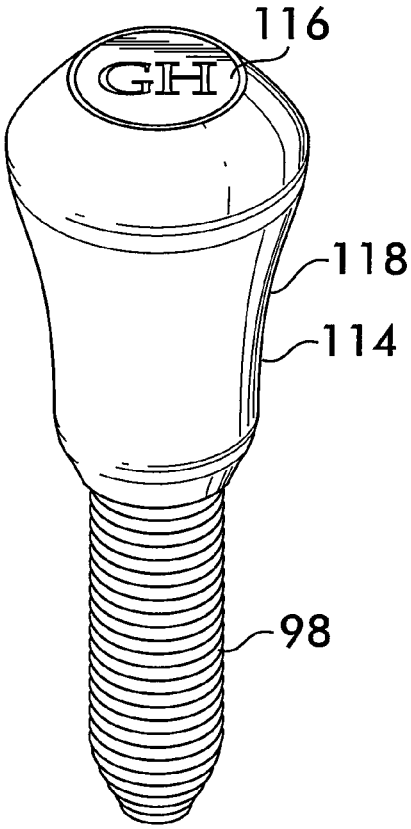
FIG.2D
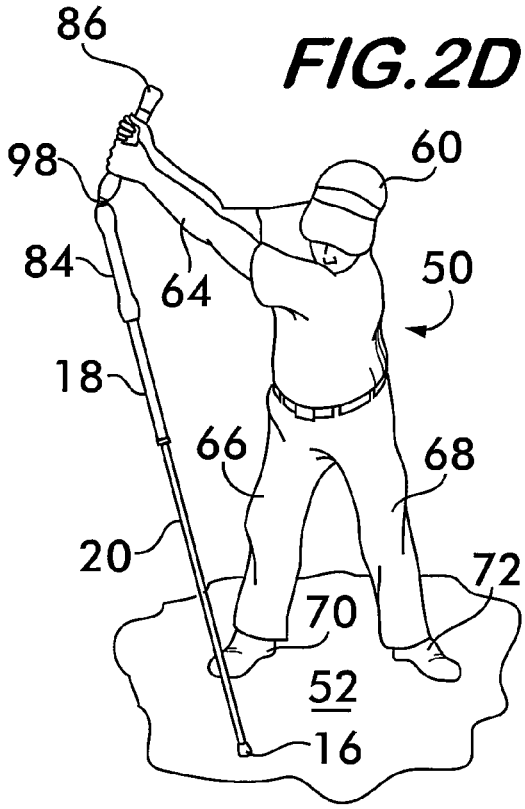
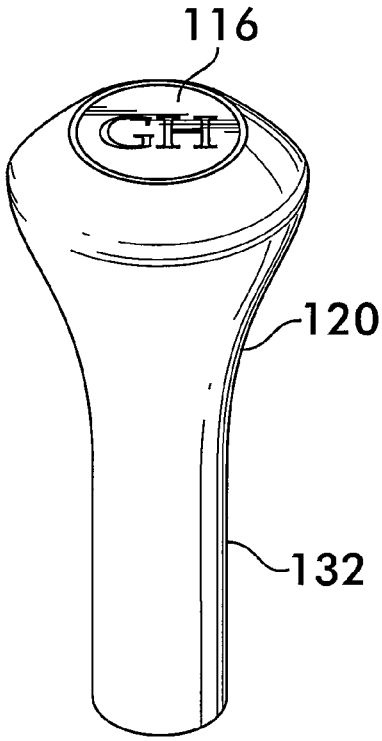
FIG.9

FIG.3
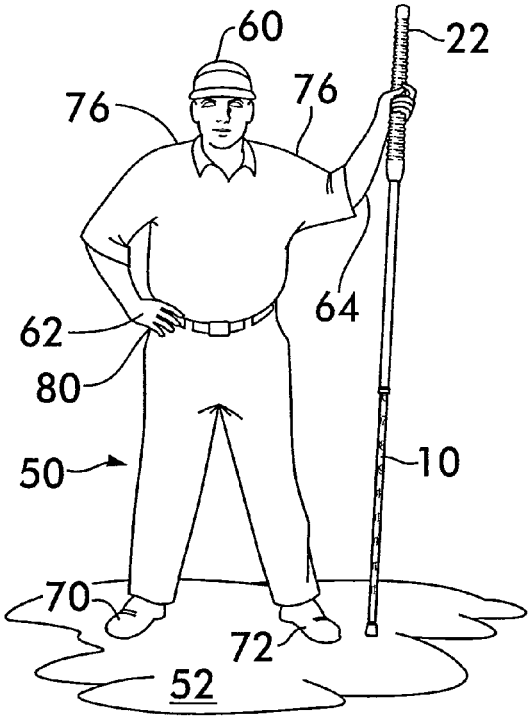
FIG.3A
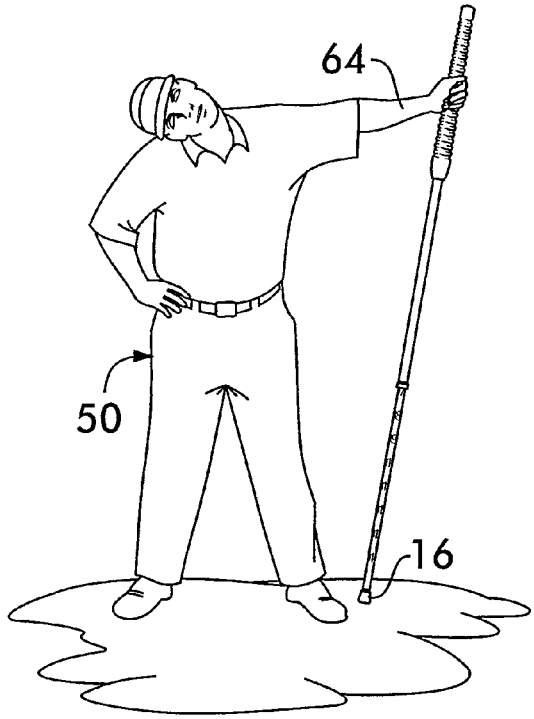
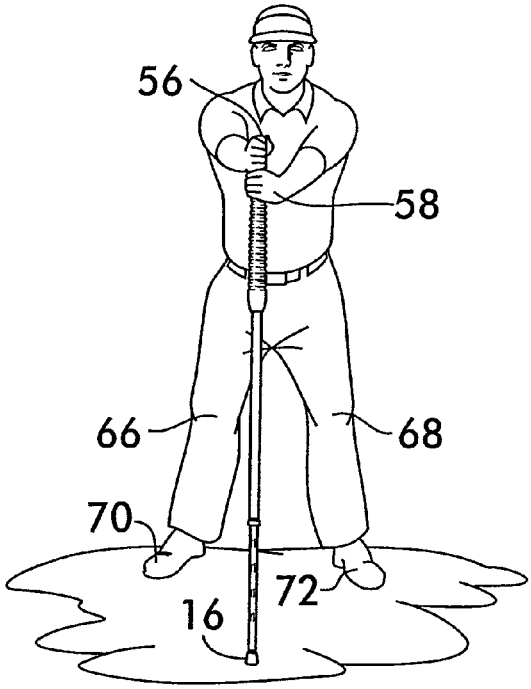
FIG.4
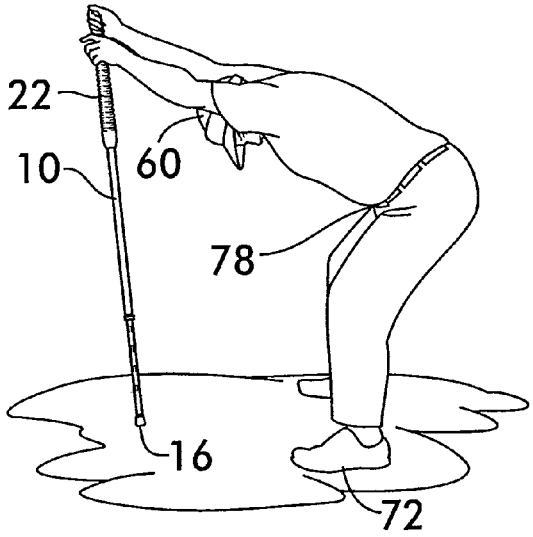
FIG.4A

FIG.5
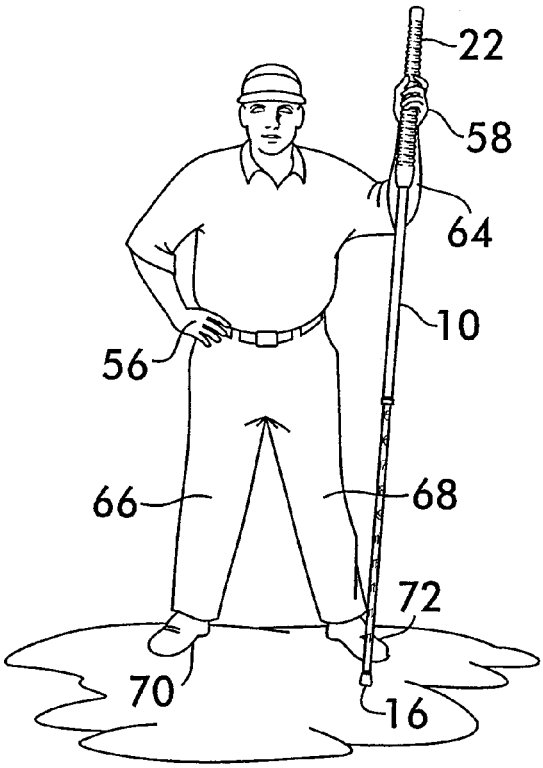
FIG.5A
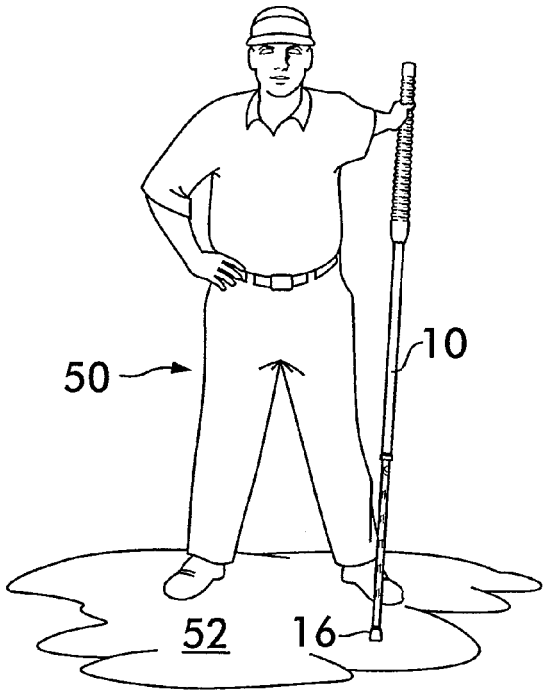
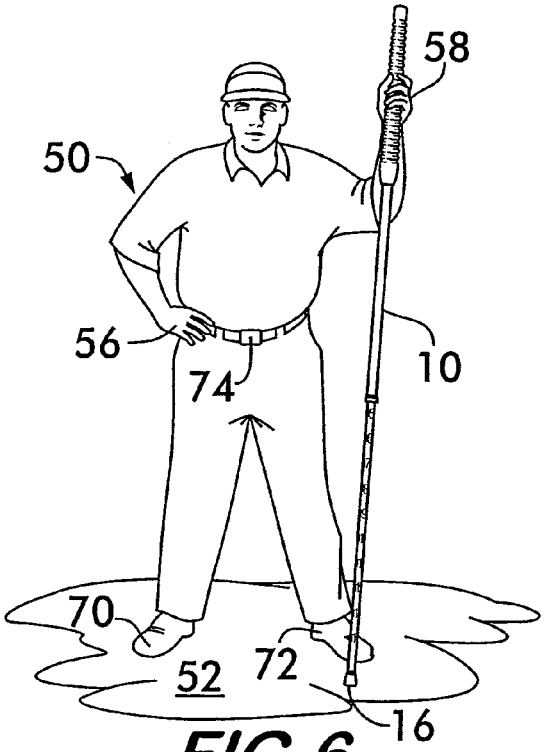
FIG.6
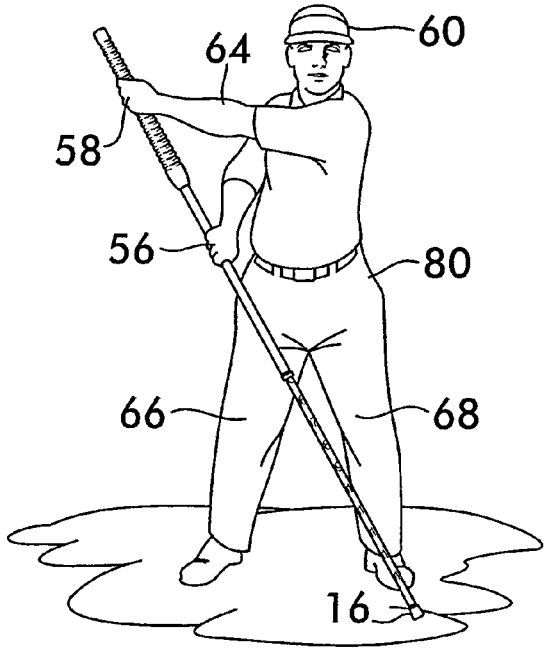
FIG.6A

EXERCISE AND STRETCHING POLE WITH FLEXIBLE HANDLE

CROSS REFERENCE TO RELATED APPLICATIONS

This application is a continuation-in-part of U.S. application Ser. No. 09/968,423 filed Oct. 1, 2001 which claims the benefit to U.S. Provisional Application No. 60/236,658 filed Sep. 29, 2000 and U.S. Provisional Application No. 60/271,522 filed Feb. 26, 2001, all of which are hereby incorporated by reference herein. The present application also claims the benefit to U.S. Provisional Application No. 60/762,555 filed Jan. 26, 2006 which is hereby incorporated by reference herein.

FIELD OF THE INVENTION

The present invention relates to exercise and stretching equipment and methods of using the same. More particularly, the invention relates to a pole or rod like device and its use for stretching.

BACKGROUND OF THE INVENTION

The benefits of stretching and strengthening muscles, particularly in sports, are well known. In baseball, for example, batters routinely swing a bat with added weight while on deck awaiting their turn at bat. Pitchers stretch and warm up by throwing many balls prior to facing the batters. Runners and swimmers likewise warm up with various stretching exercises before competing, as do football and basketball players.

Players in golf also benefit from stretching and warming up before play. In addition to a player's strength, flexibility may also affect his or her ability to drive a golf ball far. One theory is that the bigger the shoulder turns during the swing motion, the farther the player can drive the ball. Another theory holds that the longest hitters do not necessarily have the biggest shoulder turns, but rather have the widest gap, called the X-Factor, between the turning of the hips and shoulders at the top of the swing. Under this theory, the wider the gap, the farther the player can hit the ball.

A more recent theory holds that the X-Factor is not as important as the X-Factor Stretch—the gap between the hips and shoulders as the club starts down toward the ball. See P. Cheetham, P. Martin, R. Mottram, B. St. Laurent, *Second Prize: The X-Factor Stretch*, Golf Magazine, March 2001, at 98. At the beginning of the downswing, the hips start rotating before the shoulders finish turning back. Furthermore, the hips rotate faster than the shoulders, increasing the hip-shoulder separation during the early part of the downswing. Increasing this gap is believed to increase the club head speed and add power to the swing for hitting the ball farther.

There is currently known in the prior art a wide variety of training devices for improving a player's swing. Such devices typically improve the swing by teaching the proper swing mechanics. Such devices, however, do not adequately address a player's flexibility and range of motion, particularly in view of the above theories. Thus, significant improvements to a player's swing, and in particular the ability to drive a golf ball far, are believed possible with better means for improving a player's flexibility and range of motion. Improvements in other sports as well are believed possible with better means for improving a player's flexibility and range of motion. Moreover, in any sport, stretching and increased flexibility are believed to improve performance and lessen the likelihood of injury.

SUMMARY

The present invention provides a novel device for stretching muscles and increasing flexibility, and novel methods for using the device. In one form the invention provides for an exercise and stretching device which can be held in one location against the ground by a user for performing exercise and stretching motions. The device has an elongated rod having an upper end and a lower end. A handle is positioned on the rod at the upper end and at least a portion of the handle is bendable relative to the remainder of the device. The bendable portion of the handle is configured to be gripped by the user. A foot is positioned at a lower end of the device for contacting the ground when the device is held against the ground.

BRIEF DESCRIPTION OF THE DRAWINGS

The foregoing summary, as well as the following detailed description will be better understood when read in conjunction with the figures attached hereto. For the purpose of illustrating the invention, there is shown in the drawings several embodiments. It is understood, however, that this invention is not limited to the precise arrangement and instrumentalities shown.

Referring now to the drawings in which numbers indicate corresponding elements throughout the several views:

FIG. 1 is a front view of an embodiment of a stretching device in accordance with the present invention shown in a nonextended position;

FIG. 1A is a front view of the device of FIG. 1 shown in an extended position;

FIGS. 2, 2A, 2B, 2C and 2D are a series of illustrations showing the device of FIG. 1 being used for a full swing stretch, FIG. 2D being an alternative position of what is illustrated in FIG. 2A;

FIG. 2D is an illustration showing an embodiment of the device having a flexible handle being used for a full swing stretch;

FIGS. 3, and 3A are a series of illustrations showing the device of FIG. 1 being used for a neck stretch;

FIGS. 4, and 4A are a series of illustrations showing the device of FIG. 1 being used for a back stretch;

FIGS. 5 and 5A are a series of illustrations showing the device of FIG. 1 being used for an arm stretch;

FIGS. 6 and 6A are a series of illustrations showing the device of FIG. 1 being used for an across chest stretch;

FIG. 8 is a perspective view of a cap for replacing the flexible handle shown in FIG. 7; and FIG. 9 is a perspective view of an alternative cap for replacing the flexible handle shown in FIG. 7.

DETAILED DESCRIPTION OF THE PREFERRED EMBODIMENT

Several embodiments of the invention will now be described in more detail. While the embodiments described are ideal for stretching exercises to improve a golf player's swing and his or her ability to drive a golf ball to greater distances, the invention also may be used in relation to other activities and sports.

Figure 1B:
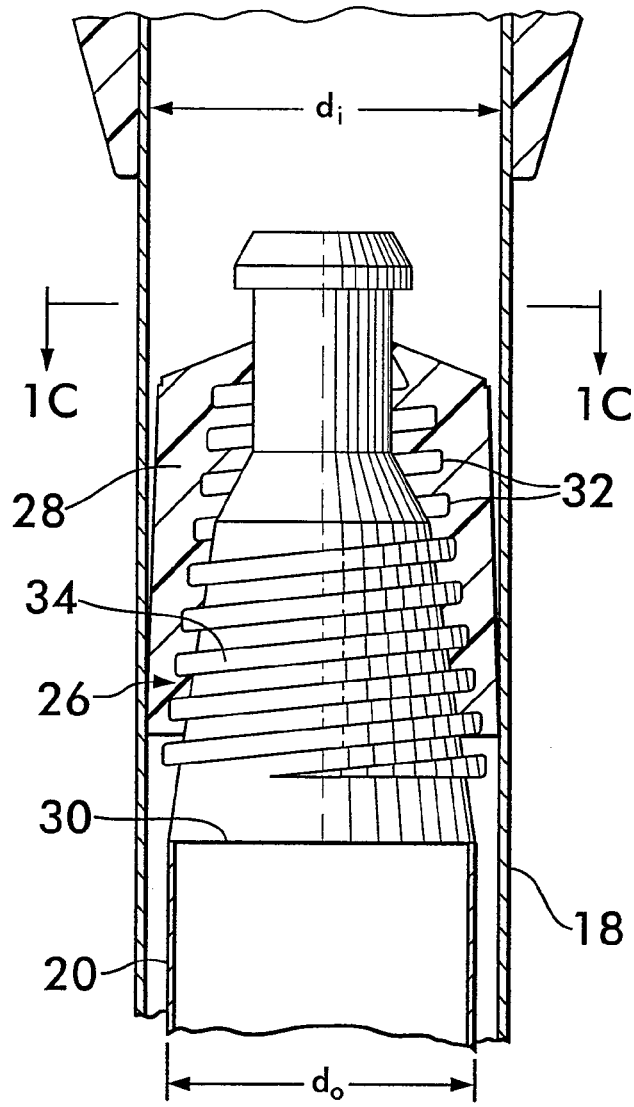
FIG. 1B is a sectional view taken along line 1B-1B of FIG. 1 and showing a lock mechanism.

Referring to FIG. 1, a stretching device 10 of the present invention includes an extendable elongated rod 12 having an upper end 14 and a lower end 16. The rod 12 includes a first hollow cylindrical section 18 having an inner diameter $d_i$ (FIG. 1B) and a second cylindrical section 20 disposed axially within the first section 18 and having an outer diameter $d_o$ smaller than the inner diameter $d_i$ of the first section 18 to permit telescopic displacement of the second section 20 within the first section 18. The first and second sections 18, 20 of the rod 12 are preferably made of steel for strength, although any suitable material such as aluminum and plastics may be used.

The rod 12 is preferably extendable from a closed or non-extended longitudinal length of 44" as shown in FIG. 1 to a fully extended longitudinal length of at least 6'6" to be useable by most people. The outside diameter of the first section 18 is about 1 inch, the outer diameter of the second section 20 is about ⅞ inch. Smaller or larger rods 12 can be used, as well as sections of different cross sectional shapes and diameters.

Fixed at the upper end of the rod 12 is a hand grip 22. The grip 22 is preferably between about 18" and 22" in length and made of a foam rubber or other material that can be gripped readily by the user. The grip may have finger indentations or a rib like design as shown to improve the gripping. The grip can also be tapered from the top (smaller thickness or diameter) to the bottom of the grip (larger thickness or diameter) as shown to help the user maintain the grip of the device 10 while applying downward pressure on the device 10. Any alternative grip may be used.

Fixed to the rod 12 at the bottom end 16 of the rod 12 (on the second section 20), is a foot member 24 for contacting the ground when the device 10 is in use. The foot member 24 is formed preferably as a rubber cylindrical knob which resists slipping against the ground. Other suitable types of foot materials and configurations that resist slipping can be used, such as elastomeric, plastic and other such materials which allow the device to be used on grass and/or on hard surfaces. Elastomeric materials that will not damage an indoor floor surface may be desirable for use indoors.

Figure 1C:
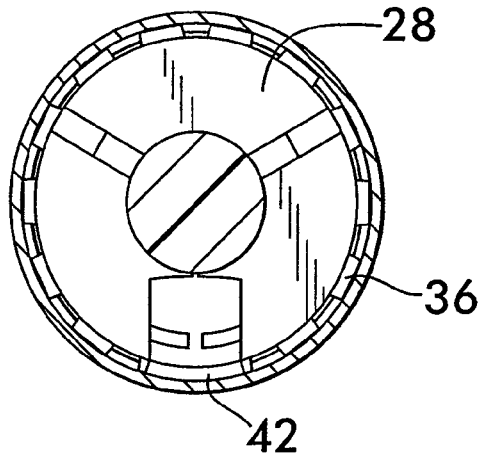
FIG. 1C is a sectional view taken along line 1C-1C of FIG. 1B.

The first and second sections 18, 20 of the rod 12 can be selectively locked together to fix the position of the two sections relative to one another at the desired longitudinal length of rod 12, it being appreciated that the two rod sections 18, 20 can be locked together at any length between the non-extended length and the fully extended length of the rod 12, i.e., there being multiple possible lengths at which the rod 12 can be locked. A lock 26 for fixing together the two sections 18, 20 can take on any suitable form. One type of locking mechanism 26 is illustrated in FIGS. 1B and 1C. This is similar to the type of lock mechanisms used in common extension poles for paint rollers sold in hardware stores. With such lock mechanisms, rotation of one of the sections 18, 20 of the rod 12 relative to the other locks the two sections 18, 20 to fix the length of the rod. Rotation of the sections in the opposite direction loosens or unlocks the sections 18, 20 so that the length can be adjusted again (the term "releasably lockable" as may be used herein meaning that the lock can be locked and unlocked). The lock 26 includes a cylindrical collet 28 attached to a top end 30 of the second section 20 of the rod 12. The collet 28 has threads 32 to threadingly engage and rotate about a tapered threaded screw like member 34 fixed to the top end 30 of the second section 20. Ribs 36 on the collet 28 engage the inside wall of the first section 18 to help prevent the collet 28 from rotating with the rotation of the second section 20, and a stop member 38 prevents the collet 28 from detaching from the second section 20. It is seen that rotation of the second section 20 and the threaded member 34 therewith relative to the collet 28, depending on the direction of the rotation, can pull the collet 28 downward over the tapered threaded member 34 thereby spreading the collet 28 to make a friction lock with the inside wall 40 of the first section 18, or push the collet 28 upward to loosen the friction lock. A slotted opening 42 in the collet 28 allows the diameter of the collet 28 to be increased or decreased with rotation of the collet 28 relative to the tapered threaded member 34.

With reference to FIGS. 1 and 1A, located on the outer surface of the second section 20 of the rod 12 are indicia 44 for aiding the user in extending the device 10 to the desired length. The indicia 44 can be calibrated to indicate the length of the rod 12 in various extended positions (such as units of inches or centimeters), or act simply as a reference point to aid the user in extending the rod to the desired length (relative length). The outer surface of the lower section 20 may also be made capable of retaining markings, such as ink, to allow the user to make his or her own markings thereon such as reference markings. Located on the outer surface of the first section 18 of the rod 12 are instructions for use. Here, the instructions include pictures 46 illustrating particular uses of the rod 12. Written instructions may also be included.

The present device 10 as illustrated and described herein is believed to be in compliance with USGA Rule 14-3 and thus can be stored in a golf bag for carrying onto a golf course.

Having described a preferred embodiment of the stretching device 10, methods of improving a golfer player's swing using such a device will know be described. These methods, however, are believed useful for other sports as well, and for all around physical conditioning.

Full Swing Stretch

With reference to FIGS. 2, 2A, 2B, and 2C, a full swing stretch is now described for a right-handed player 50. With particular reference to FIG. 2, the golfer 50 assumes the position to address the ball, typically standing up straight with feet shoulder width apart and knees slightly flexed. The arms are extended fully straight out in front, back straight, the distance between the inside of the feet set apart approximately the width of the shoulders. With the device 10 in hand and preferably already extended to the desired length, the player 50 places the lower end 16 of the device 10 on the ground 52 in front of him or her. Preferably, at least for the initial use of the device 10, the lower end 16 is placed on the ground 52 in the approximate area 54 where a golf ball would be teed up. The device 10 is gripped with both hands (right-hand 56 and left-hand 58) along the grip 22 in a manner similar to that of gripping a golf club (as if the golf club were being held vertically with the head of the club at the top, i.e., right-hand 56 on top of left-hand 58 with thumbs on the top of the hands). The device 10 is gripped at a height preferably 1" to 2" above the player's head 60.

With reference to FIG. 2A, the back swing is then begun in a manner similar to the swinging of a golf club. While maintaining the grip of the device 10 and the position of the lower end 16 on the ground 52, the golfer 50 rotates the upper body to the right, moving the hands to the full back swing position. The left arm 64 should remain fully extended through this motion, the right knee 66 kept inside the right foot 70, and the head 60 kept centered. This position can be held if desired, e.g., for about thirty (30) seconds to fully stretch the muscles.

To increase coil and turn, the player 50, while holding the back swing position, draws the lower end 16 of the pole close to his/her right foot 70 progressively. This position can also be held, e.g., thirty (30) seconds.

As another option, to maximize stretching, the player, while maintaining the back swing position, can drop to a sitting position slowly. See FIG. 2B. The player 50 should feel additional back stretching. This position can be held, e.g., thirty (30) seconds.

To complete the full swing stretch, the player can swing from the full back swing position as shown in FIG. 2A to the finished down swing position as shown in FIG. 2C. The player 50 begins the down swing and continues to the finished position in a manner similar to the swinging of a golf club driver. The body is turned to the left, moving the right knee 66 toward the left knee 68, winding up in a completed swing position—the belt buckle 74 facing the target, right foot 70 up on toes, back straight, standing tall, right arm 62 kept straight, and with head 60 facing the target (where the user would want to drive the golf ball). The finished position can be held for a full stretch, e.g., thirty (30) seconds.

The device 10 can be moved back and forth between the full back swing and finished positions as many times as desired to stretch the muscles. The above movements can be modified as desired. For example, one could concentrate on the back swing, moving back and forth between the center position of FIG. 2 and the full back swing of FIG. 2A. Likewise, the position on the ground of the lower end 16 of the device 10 can be moved as described above to concentrate on certain muscles. A left-handed player would reverse the movements discussed above.

The device 10 can be used to improve golf swings for various clubs. For example, the swing related to a five iron, which is a shorter club than a driver, requires a different stance than that of a driver. Accordingly, the golfer, assuming the proper stance for the 5 iron, can set the device 10 on the ground in a position where the ball would be teed up, and grip the device 10 at a position 1 to 2 inches above the head. Because the head position for a 5 iron swing is lower than that of a driver swing, the device 10 can be extended to a smaller length than would be desirable for the driver swing.

A major benefit of the full swing stretch is the ability to increase the club head speed and thus the driving distance of the golf ball by improving the golfer's flexibility and swing arc. For example, the golfer can urge his or herself into the upper most top back swing position possible in an effort to stretch the muscles and increase the top of the back swing.

The full swing stretch as described above may be modified for use relating to other sports. For example, to improve a baseball swing, it may be beneficial to use the pole 10 in a similar manner as described above but with the lower end 16 positioned on the ground closer to the feet of the user.

Neck Stretch

With reference to FIGS. 3 and 3A, a method of using the device 10 for stretching the neck and upper arm muscles is now described. With the device 10 fully extended, the player or user 50 stands up straight with feet 70, 72 shoulder width apart. The device 10 is placed on the side of the left foot 72 in line with the shoulder 76. The right arm 62 is placed on the hip 80 and the pole device 10 gripped at shoulder height with the left arm 64. The left arm 64 is then straightened and the head 60 tilted to the right (see FIG. 3A). This position may be held to maximize the stretch, e.g., thirty (30) seconds. The above method can be reversed to stretch the other side. This stretch is also believed to help increase club head speed, and thus driving distance, by stretching and increasing the flexibility of key muscles.

Back Stretch

With reference to FIGS. 4 and 4A, a method of stretching back muscles, which is also believed to help increase club head speed, is described. The device 10 is preferably lowered to chest height and the hands 56, 58 placed on top. The player 50 stands up straight with feet 70, 72 wider than shoulders and knees 66, 68 slightly flexed. The device 10 is held at arm's length away with the end 16 on the ground. Arms are held away (see FIG. 4).

The player then bends from the waist 78 and places his/her head 60 between its arms. Next, while maintaining the grip on the device 10, the player moves slowly to a sitting position (see FIG. 4A). This final position can be held, e.g., for thirty (30) seconds to maximize the stretch.

Arm Stretch

With reference to FIGS. 5 and 5A, a method of stretching arm and shoulder muscles, also believed to help increase club head speed, is described. With the device 10 fully extended a suitable length, the player 50 stands up straight with feet 70, 72 shoulder width apart and knees 66, 68 slightly flexed (see FIG. 5).

The device 10 is placed in the left-hand 58 about two (2) inches in front of the left foot 72, the right-hand 56 placed on the hip 80. The player 50 then rotates the left arm 64 behind him or her as far as possible as seen in FIG. 5A. Shoulders should be kept square, chest forced out, and shoulders pulled back. This final position can be held, e.g., thirty (30) seconds to maximize the stretch. This can be repeated with the opposite arm.

Across Chest Stretch

A method of stretching various muscles in the shoulders and between the shoulders and back is now described with reference to FIGS. 6 and 6A. With the pole device 10 fully extended, the player 50 assumes a position standing straight up with feet 70, 72 shoulder width apart and knees 66, 68 flexed. The pole device 10 is placed in the left-hand 58 two (2) inches in front of the left foot 72, and the right-hand 56 placed on the hip 80 (see FIG. 6).

Next the left arm 64 is extended straight and swung across the body as shown in FIG. 6A. The right-hand 56 is then placed palm down on the pole 10 waste high. With hips 80 kept square, the user 50 pulls back on the device 10 with the right-hand 56 and flexes the knees 66, 68 slightly. This final position can be held, e.g., thirty (30) seconds to maximize the stretch. This method can be reversed for the other side.

Flexible Handle Embodiment

Figure 7:
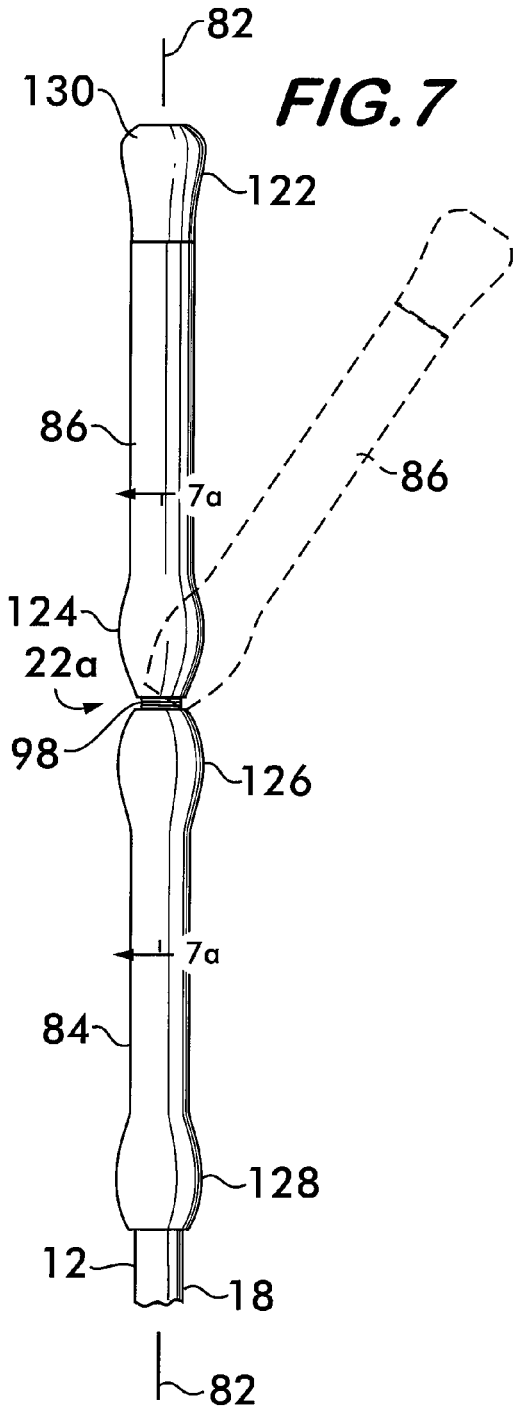
FIG. 7 is a front view of another embodiment of a stretching device in accordance with the present invention which is similar to the device shown in FIG. 1 but which has a flexible handle.
Figure 7A:
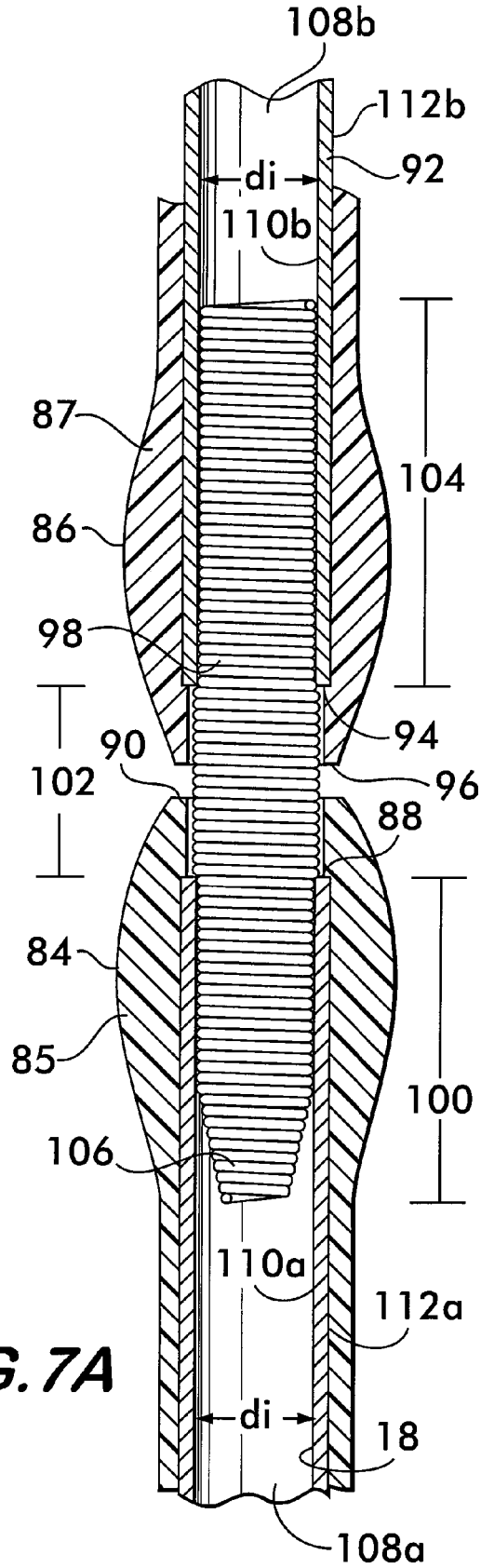
FIG. 7A is a cross sectional view of the handle portion of the device of FIG. 7 taken along line 7A-7A.

With reference to FIGS. 7 and 7A, another preferred embodiment of the present invention is now described. For this embodiment, a device 10*a* has a flexible hand grip or handle 22*a* fixed at the upper end of the rod 12 as shown. The rod 12 is preferably extendable and can be formed of first and second hollow cylindrical sections 18 and 20 in the same manner as that described above with reference to the device 10 of FIG. 1, with like reference numbers indicating similar elements, and thus only the top portion of the device 10*a* is shown in FIG. 7. At least a portion of the handle 22*a* can be bent or flexed during use to follow the natural movements of the hand and/or wrist during the particular exercises, thereby relieving stress on the user's hand and wrist. The rod 12 has a longitudinal axis 82 which, in the present embodiment where the rod sections 18, 20 are formed as a straight longitudinal rod 12 as shown in FIG. 1, runs through the center axis of the rod 12.

The handle 22*a* of this embodiment is flexible in that at least a portion of the handle 22*a* is bendable away from the longitudinal axis 82 of the rod 12 as illustrated in FIG. 7. The handle 22*a* is preferably formed as two sections, a first or lower section 84 and a second or upper section 86 which, in this embodiment, is the portion of the handle 22*a* that is bendable (the dotted lines show a bent position of the upper handle section 86). Each of the two handle sections 84 and 86 are configured to be gripped by a user.

With further reference to FIG. 7A, it is seen that the lower handle section 84 has a cylindrical lower foam grip 85 fixed to the first rod section 18 such that an upper end 88 of the first rod section 18 ends short of an upper end 90 of the lower foam grip 85 by a preferred distance of about ½ inch although this distance can be shorter or longer as necessary or desired including a preferred distance of up to about one inch. The upper section of the rod section 18 supports the foam section 85 much as it supports the entire handle 22 in the device 10 of FIG. 1. The lower foam grip 85 is configured to be grippable by a user for carrying out exercises using the lower handle section 84.

The upper handle section 86 has a upper foam grip section 87 fixed to a cylindrical handle support member 92 which is preferably formed of the same hollow cylindrical material as the rod section 18, although shorter in length. As seen in FIG. 7A, a lower end 94 of the handle support member 92 ends short of the lower end 96 of the upper foam grip section 87 a preferred distance of about ½ inch although this distance can be shorter or longer as necessary or desired including a preferred distance of up to about one inch. The upper foam grip 87 is configured to be grippable by a user for carrying out exercises using the upper handle section 86.

In the illustrated embodiment, the flexible handle feature is provided by a spring 98 that flexibly attaches together the first and second handle sections 84 and 86, allowing the upper handle section 86 to be bendable relative to the lower section 84 away from the longitudinal axis 82 so as to be capable of moving in any direction 360 degrees around the longitudinal axis 82; the spring 96 thereby acting as a polyaxial joint. The spring also urges the upper handle section 86 back to its original axially aligned position. In the preferred embodiment, the spring 98 is formed by a coiled spring, with a preferred distance of about three spring coils separating the upper end 90 from the lower end 96 of the respective foam grip members 85 and 87.

In a preferred embodiment, the upper handle section 86 is removably attached to the lower handle section 84 so that the upper handle section 86 can be removed from a remainder of the device 10*a* if and when desired such as to shorten the length of the device 10*a* to fit within a golf bag (45 inches in length) or where the flexible portion of the handle is not needed for carrying out particular exercises (e.g., the lower handle section 84 will be used). One preferred means of providing a removably attachable upper handle section 86 is now described with reference to FIGS. 7 and 7A.

The coiled longitudinal spring 98 of the illustrated embodiment has a first or lower section 100, a second or central section 102, and a third or upper section 104; the lower section 100 includes a tapered end 106 to help guide the spring 98 into the rod section 18 as further described below. In the illustrated embodiment, the first spring section 100 is about 2¾ inches in length (including the tapered section 106); the second central section 102 is about 2 inches in length, and the third section 104 is about 2 inches in length; other suitable lengths and configurations being acceptable.

The rod section 18 and the handle support member 92, both preferably formed of similar hollow cylindrical material, have respective hollow interiors 108*a* and 108*b* defined by respective interior walls 110*a* and 110*b* with an inner diameter di (see FIG. 1B), and respective exterior walls 112*a* and 112*b*.

The outer diameter of the first and third spring sections 100 and 104 is sized to fit within the interiors 108*a* and 108*b* of the rod section 18 and handle support member 92, preferably a snug fit requiring that the two sections 100 and 104 be twisted into the respective interiors 108*a* and 108*b* with the spring coils acting as threads. The spring section 104 is permanently attached to the handle support member 92 within the interior 108*b*. A deformation of the handle support member 92, such as a crimp in the walls 112*b* can permanently attach the handle support member 92 to spring section 104. The lower spring section 100 can be removably attached to the upper rod section 18 by inserting the lower spring section 100 into the hollow interior 108*a* such that the interior wall 110 engages the spring 98 and, being sized to fit tightly therein, cannot move further into the hollow interior of the rod section 18. The spring 98 is then rotated in a direction such that the lower spring section 100, frictionally held by the interior walls of the rod 18, gets smaller in diameter, allowing the spring section 100 to be pushed further into the rod 18. Continued rotation of the spring 98 allows the spring section 100 to be fully inserted within the interior of the rod 18. It is seen that the middle section 102 of the spring 98 has a diameter sufficiently larger than the diameter of the lower spring section 100 such that the larger diameter acts as a stop to prevent further ingress of the spring 98 into the hollow section of the rod 18. It is seen that when the handle is bent as seen in FIG. 7, the middle spring section 102, which is not fixed to the upper or lower handle sections 84, 86, is the portion of the spring 98 that bends; this includes a portion of the middle spring section 102 that is exposed between the upper and lower handle sections 84 and 86, as well as the portions of the middle spring section 102 between the upper end 90 of the handle section 84 and the upper end 88 of the rod 18, and the section between the lower end 96 of the handle section 86 and the lower end 94 of the handle support 92. The upper handle section 86 can be removed from the lower handle section 84 by rotating the upper handle 86 in the same direction as when attaching the upper handle section 86 while at the same time pulling the upper handle section 86 out from the lower handle section 84. It is seen that the rotation lessens the diameter of the spring to allow removal thereof.

A preferred method of making the device 10*a* as illustrated in FIG. 7 is now described. A rod 12 having first and second cylindrical hollow rod sections 18 and 20 as described above is provided. A top section of the rod 18 is cut off to form the handle support member 92. Any additional length is also removed as needed to form the desired extended length of the device 10*a*.

Next the lower foam grip section 85 is slid over the upper end 88 onto the rod section 18 to a position well below the end 88 of the rod section 18. The spring section 102 is then twisted (rotated) into the interior 108*a* of the rod section 18 until the larger diameter center spring section 104 contacts the rod end 88 to prevent any further ingress. The third spring section 106 is then twisted into the interior 108*b* of the handle support member 92 (by turning the handle support member 92 into the spring 98) until the center spring section 104 again stops any further insertion movement. The outer wall 112*b* of handle support member 92 is then crimped to fixidly attach the spring 98 thereto.

Next, an adhesive, such as Liquid Nails®, is applied to the outer wall 112*b* of the support member 92, and then the upper foam section 87 is slid downward over the handle support member 92 until the lower end 96 of the upper foam section 87 is at the desired position. The foam grip section 87 is twisted one full turn to ensure that the adhesive is spread sufficiently around the support member 92. Likewise, adhesive is applied to the rod 18 outer wall 112*a* and then the lower foam grip section 85 is slid back up until the upper end 90 of the foam grip 85 is at the desired position, the foam grip section 85 being twisted one full turn to spread the adhesive.

The flexible portion of the handle, here upper handle section 86, is detachable so that the stretching poll 10*a* can be used with or without it, depending on the exercise. Detaching the handle section 86 also makes the overall length of the device 10*a* short enough to fit into a golf travel bag. Caps can be inserted into the top opening of the lower handle section 84 after the upper handle section 86 is removed to maintain the aesthetic look of the device 10*a* as well as to prevent moisture and other undesirable matter from getting into the interior space of the rod section 18.

With reference to FIGS. 7 and 7A, a preferred handle shape is now described. Here, the handle 22*a* has first and second sections 84 and 86 which are similar in shape. The upper foam section 87 has an upper bulbous section 122 and a lower bulbous section 124. As seen, the lower bulbous section 124 has a tapered section on the upper part of the bulb 124 that increases in diameter moving downwards. This helps the user to maintain its grip on the handle 22*a* and prevent slippage. Similarly, the lower foam handle section 85 has an upper bulbous section 126 and a lower bulbous section 128. The lower bulbous section 128 as a tapered section on the upper part of the bulbous section that increases in diameter moving downwards to help prevent slippage when the user uses the lower handle section 84 for exercises. The top 130 of the upper handle section 86 is substantially flat and can have a medallion (see, e.g., FIG. 8) installed thereon as desired. Another preferable handle shape is that shown in FIG. 1, but with the handle 22 cut into two sections, the lower section forming part of the lower handle section 84, the upper section forming part of the upper handle section 86.

With reference to FIG. 8, a cap 114 has a spring 98 similar to the spring used with the upper handle section 86 for insertion into the hollow internal area 108*a* of the rod 18. A cylindrical handle support (not shown), similar to the handle support 92 discussed above with reference to the upper handle section 86, can be provided for use in connecting the spring 98 to the foam grip section 118. Here the spring 98 works identically to that discussed above, i.e., it is removably attached to the top of the rod 18 by rotating the spring 98 so as to shorten the diameter of the spring. Once the spring 98 is fully inserted, rotation of the 114 is stopped so that the spring returns to its normal diameter, thereby frictionally attaching the cap 114 to the rod 18. A personalized medallion 116 can be provided on the top of the cap 114 to show the name of the golf club, initials of the user, or whatever is desired. Another cap embodiment is shown in FIG. 9. This cap 120 is made of all foam and has a thinner neck area 132 that can be easily pushed into the opening at the top of the rod 18 when the upper handle section 86 has been removed. The cap 120 can also include a medallion 116 as shown.

The flexibility of the handle 22*a* allows the user's hand to bend in a natural way during use of the device, thereby relieving stress and pressure on the hand and wrist as shown in FIG. 2D, which illustrates the flexible handle embodiment being used to carry out the full swing stretch. This is similar to the exercise described above with reference to FIGS. 2-2C except that as the rod 10 (10*a*) is moved to the backswing position, the user can bend his or her wrists as shown in FIG. 2D (instead of FIG. 2A) before completing the exercise as shown in FIGS. 2B and 2C. Thus, the flexible handle allows for the wrists to hinge naturally while still achieving the fully turned position and maintaining a light grip pressure. It is important that a golfer's hands at the top of his or her backswing be as relaxed as possible. This constitutes an improvement for the full swing stretch as compared with a device having a non-flexible handle.

While particular embodiments of the invention are described herein, it is not intended to limit the invention to such disclosure and changes and modifications may be incorporated and embodied within the scope of the appended claims.

Other embodiments, while not shown, are contemplated. For example, the two sections 18, 20 may have a spring between the two to allow the device to be compressible. As another example, regarding the device 10*a* of FIG. 7, the handle 22*a* may be formed of just a single handle section that is connected to the upper section of the rod 18 via the spring.

I claim:

1. An exercise and stretching device which can be held in one location against the ground by a user for performing exercise and stretching motions, comprising:

an elongated rod having an upper end and a lower end, said rod having a first rod section and a second rod section moveable relative to said first rod section to adjust a length of said rod;

a handle positioned on said rod at said upper end and which is configured to be gripped by the user, said handle comprising a first section and a second section pivotally attached to said first handle section so as to allow pivotal movement of said second handle section relative to said first handle section;

a foot disposed at a lower end of said device for contacting the ground when said device is held against the ground, said foot being configured to resist slipping so as to be maintained in the one location against the ground during the exercise or stretching motion when the handle is gripped by the user and said foot is in contact with the ground; and a spring attaching said first and second handle sections together to allow said pivotal movement, wherein said spring has a first section having a diameter sized to engagingly fit within one of said rod sections, and a second section having a second diameter larger than said first diameter and which is sufficiently large to prevent said second spring section from fitting within said rod section so as to fix the length of said spring that is insertable into said one of said rod sections.

2. The device of claim 1 further comprising a lock operable to fix the length of said rod at a desired length.

3. The device of claim 1 wherein said portion of said handle is attached to the remainder of said device so as to be capable of moving in any direction 360 degrees around a longitudinal axis extending through said remainder.

4. The device of claim 1 wherein said portion of said handle is removable from a remainder of said device so as to be capable of being detached from said device.

5. The device of claim 1 wherein said spring has a third section having a third diameter smaller than said second diameter and which attaches to said second handle section.

6. The device of claim 1 wherein said handle is tapered, at least over a portion of said handle, increasing in thickness in a direction away from said upper end of said handle toward a lower end.

7. The device of claim 1 wherein said foot comprises an elastomeric member attached to the lower end of said rod for contacting the ground when said device is held against the ground.

8. The device of claim 1 wherein both first and second handle sections are configured to be gripped by the user.

9. A method for improving a golf swing using an exercise device comprising a longitudinal rod having a longitudinal axis and having an upper end and a lower end configured for contacting the ground so as to resist slippage; a handle positioned at said upper end of said rod, wherein at least a portion of said handle is grippable by a user; and wherein said handle comprises a first section and a second section pivotally attached to said first handle section so as to allow polyaxial movement of said second handle section away from said longitudinal axis of said rod for bending away from said longitudinal axis, said method comprising a user of the device doing the following:

(a) placing said lower end of said rod on the ground in front of the user;

(b) gripping said bendable portion of said handle with both hands;

(c) assuming an approximate position for addressing a ball;

(e) moving the user's arms to a back-swing position while maintaining said grip and keeping said lower end of said rod on the ground; and (f) bending the user's wrist so as to bend said bendable portion of said handle relative to a remainder of said exercise device.

10. The method of claim 9 further comprising:

(f) moving the user's arms to a finish-swing position while keeping said lower end of said rod member on the ground.

11. The method of claim 10 wherein step (f) is carried out after step (e).

* * * * *